United States Patent [19]

Seeber et al.

[11] Patent Number: 4,886,021

[45] Date of Patent: Dec. 12, 1989

[54] MULTI-CYLINDERED TWO STROKE CYCLE ENGINES

[75] Inventors: Kenneth P. Seeber, Wanneroo; Christopher K. Schlunke, Kingsley, both of Australia

[73] Assignee: Orbital Engine Company Proprietary Limited, Balcatta, Wertern, Australia

[21] Appl. No.: 158,722

[22] Filed: Feb. 23, 1988

[30] Foreign Application Priority Data

Feb. 25, 1987 [AU] Australia ..... PI0523

[51] Int. Cl.[4] ..... F02B 33/04

[52] U.S. Cl. ..... 123/73 PP; 123/193 C

[58] Field of Search ..... 123/73 PP, 73 A, 193 C, 123/41.74, 41.79, 41.84, 65 PE, 65 P

[56] References Cited

U.S. PATENT DOCUMENTS

| | | | |
|---|---|---|---|
| 4,075,985 | 2/1978 | Iwai | 123/73 B |
| 4,167,160 | 9/1979 | Matsushita et al. | 123/73 A |
| 4,287,860 | 9/1981 | Fujikawa et al. | 123/73 PP |
| 4,414,928 | 11/1983 | Nakada | 123/73 PP |
| 4,683,846 | 8/1987 | Takayasu | 123/73 B |

*Primary Examiner*—David A. Okonsky

*Attorney, Agent, or Firm*—Armstrong, Nikaido, Marmelstein, Kubovcik & Murray

[57] ABSTRACT

A multi-cylinder engine block for an engine operating on the two-stroke cycle and having two or more adjacent cylinder bores (10,11,12) with the axes of the bores parallel and in a common longitudinal plane. Each cylinder bore having an exhaust port (20), and an exhaust passage (21) extending from each exhaust port (20) to an external surface (22) of the block in a direction generally at right angles to said common longitudinal plane (25). Two transfer ports (27,28) being provided communicating with the same cylinder bore on either side of the exhaust port in the direction of said common longitudinal plane. Each transfer port communicating with a respective transfer passage. The transfer ports (27,28) not extending beyond the common longitudinal plane (25), and the transfer passages (26,23) adjacent the respective transfer ports (27,28) extending in a direction generally tangential to the cylinder bore. The transfer ports (27,28) and transfer passages (23,26) being configured and located so the axes of two adjacent cylinder bores are spaced apart not more than about 1.22 times the diameter of the cylinder bores.

10 Claims, 6 Drawing Sheets

FIGURE. 4
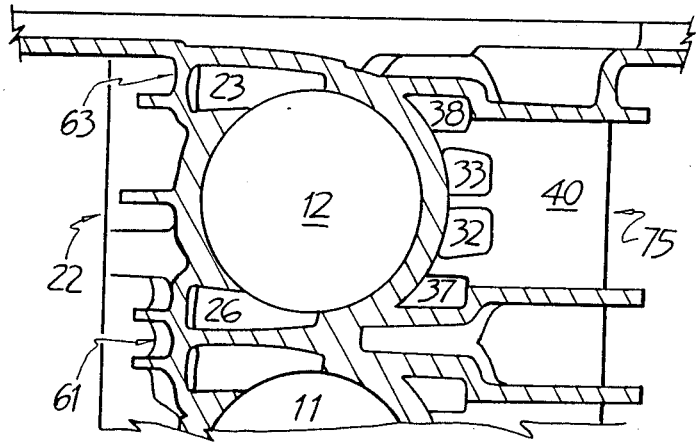
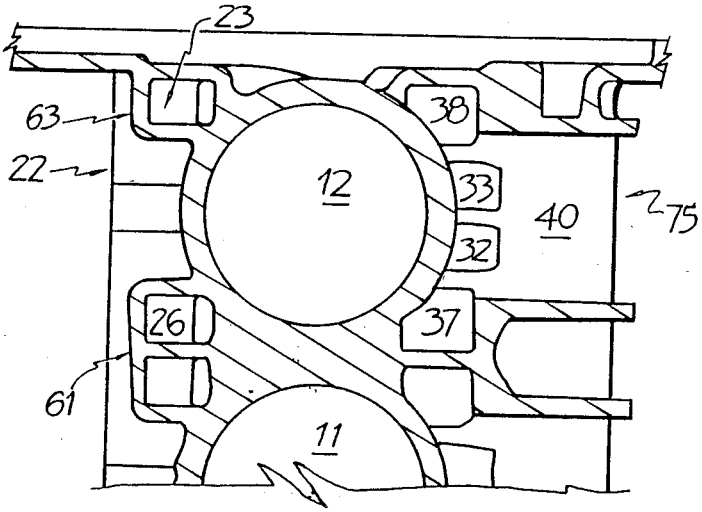
FIGURE. 5

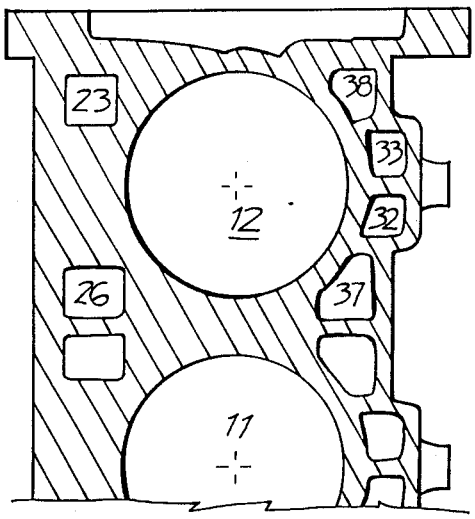
FIGURE. 6
FIGURE. 8
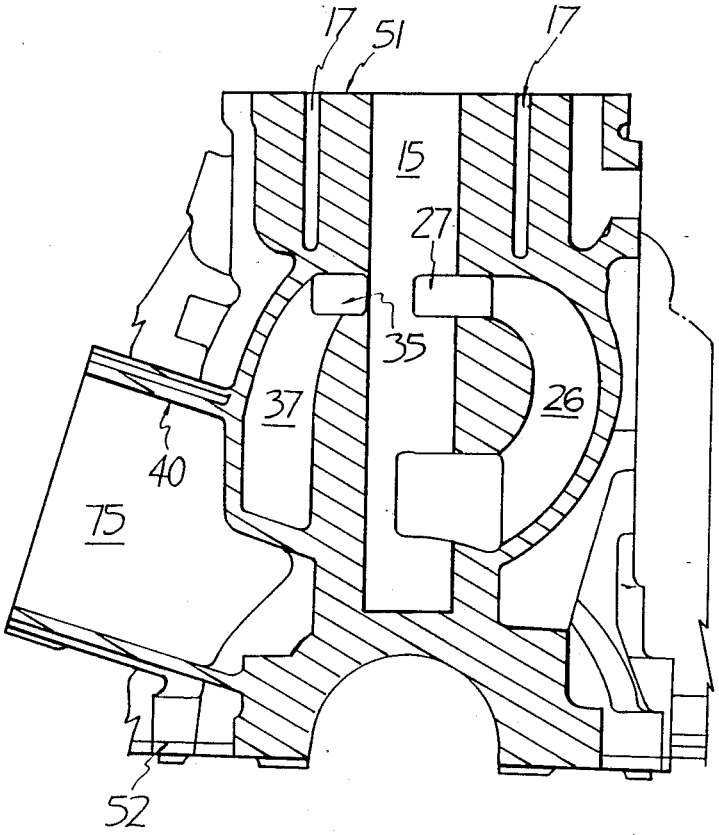

MULTI-CYLINDERED TWO STROKE CYCLE ENGINES

This invention relates to multi-cylinder engines operating on the two stroke cycle and incorporating exhaust ports and inlet or transfer ports in the peripheral wall of the respective cylinders.

In order to obtain the desired gas flow within the cylinder of an engine operating on the two stroke cycle, to achieve the required power output, fuel efficiency, and exhaust gas emission control, the disposition of the exhaust port and transfer ports is a critical factor.

It is a feature of engines operating on the two stroke cycle that the transfer ports and the exhaust port or ports are open at the same time in the engine cycle and so there is a potential for part of the fresh charge entering the cylinder through the transfer ports to travel across the cylinder and escape through the exhaust port during the period that both the exhaust and transfer ports are simultaneously opened. This problem can not be solved by arranging the transfer and exhaust ports so that they are not both open at the same time as the fresh charge entering through the transfer ports is required to assist in the scavenging of the exhaust gas from the cylinder through the exhaust port.

Various arrangements of transfer and exhaust ports around the periphery of a cylinder of a two stroke cycle engine have been proposed with the aim of obtaining effective scavenging of the exhaust gases from the engine with a minimum loss of fresh charge through the exhaust port. In early proposals the transfer ports were located generally on the opposite side of the engine cylinder to the exhaust port and a hump was provided on the crown of the piston of the engine to direct the fresh charge entering the cylinder through the transfer ports, upwardly in the cylinder. The upward movement of the fresh charge increased the length of the flow path thereof to the exhaust port and so reduced the amount of fresh charge reaching the exhaust port within the time available. Also the upward flow of the fresh charge promoted the flow of exhaust gases within the upper part of the cylinder towards and through the exhaust port.

Although the provision of the hump on the piston crown assisted in obtaining the required control of the flow of the incoming fresh charge, it introduced new problems in the effective operation of the two stroke cycle engine. In particular, the hump required the provision of a somewhat complementary cavity in the cylinder head, in order to obtain an acceptable compression ratio, and thus provided a substantial restriction on the design of the cylinder head and the resultant combustion space. This restriction has prevented the optimization of the shape of the combustion space in order to obtain the desired control over the combustion process for maximum efficiency and emissions control. In addition the hump on the crown of the piston presented a substantial surface area to the combustion gases and therefore generated a high heat input to the piston giving rise to difficulties in cooling the piston and thermal stresses in the piston.

The two stroke cycle engine discussed above is generally referred to as a cross-scavenged engine and engines operating on this principal are basically recognized by the hump on the piston crown, which is normally offset from the center line of the piston towards the transfer ports and extends substantially across the full extent of the crown of the piston at that location. In order to overcome the problems associated with the cross-scavenged engine there was subsequently developed a configuration of transfer ports which would establish a generally upwardly directed flow within the engine cylinder of the incoming fresh charge without the necessity to provide the hump on the crown of the piston.

This later development is generally referred to as a loop-scavenged engine and in a typical modern example the cylinder has a generally centrally located transfer port or ports opposite the exhaust port and additional transfer ports on either side of the central transfer port orientated to direct the incoming fresh charge from these side ports away from the exhaust port and towards the central transfer port. The combined effect of the central and side transfer ports is to create an upward flow of the incoming fresh charge on the side of the cylinder opposite to the exhaust port, thereby avoiding a direct cross-over of the incoming charge to the exhaust port. An example of the exhaust and transfer ports in a loop-scavenged engine is illustrated in British Pat. No. 1021378, that engine being provided with further transfer ports 26 between the exhaust port 19 and the respective side transfer ports 20. However, it will be noted that the additional transfer ports 26 are also orientated to direct the charge entering therethrough across the cylinder towards the central transfer port 23.

The configuration of the transfer ports in the loop-scavenged engine avoided the use of a hump on the crown of the piston, overcoming the disadvantages associated therewith, and succeeded in obtaining the required control over the flow of the incoming fresh charge from the transfer ports so as to obtain effective scavenging of the exhaust gases from the engine and limiting the loss of fares charge through the exhaust port. However, the provision of the transfer ports, and the required associated transfer passages between the ports and the engine crankcase, on the two opposite sides of the engine resulted in a significant increase in the overall dimension of the cylinder and associated transfer ports and passages in a direction at right angles to the axis of the exhaust port. This can be readily seen in FIG. 3 of the above referred to British patent wherein the dimension across the engine between the rear walls of the respective transfer passages 21 is approximately 1.6 times the diameter of the engine bore.

Although such an increase in the overall dimensions can be tolerated in a single cylinder engine, particularly of the cooled construction wherein the transfer passages 21 may be located within the cooling fin configuration provided on the engine, the increase in the overall dimensions of each cylinder and its transfer ports and passages is of major consideration in multi-cylinder engines, particularly of the in-line type. Other arrangements of transfer and exhaust ports in loop-scavenged engines are to be found in Australian Pat. No 152471 and German Pat. No. 590331, the latter being a patent granted to Dr. Adolph Schneurle who is credited as being the discoverer of the loop-scavenged system, which is sometimes referred to as the Schneurle scavenged system.

Although the transfer port arrangements to achieve loop-scavenging are operationally desirable to achieve effective scavenging of exhaust gases from the cylinder and the correct location of the fresh charge, the position of the side transfer ports, and the transfer passages communicating those transfer ports with the engine crankcase, present complications in the construction of multi-cylinder engines. In particular the spacing of the cylinders and the construction of the end sections of the cylinder block of a multi-cylinder engine must be sufficient to accommodate the transfer ports and associated transfer passages. It is readily seen from the above referred to prior disclosures of various loop-scavenged engine constructions that these constructions, if applied to a multi-cylinder in-line engine, would require a substantial spacing between cylinders and a resulting substantial increase in the overall length of the engine. This increase in engine block length results in a corresponding increase in engine weight, and in automotive applications, an increase in engine compartment size and overall vehicle size and weight.

In an attempt to reduce the size of such multi-cylinder engines, it has been the practice to skew the scavenging axis of each cylinder with respect to the common longitudinal plane of cylinders, to thus obtain a somewhat nesting relationship between the transfer passages of the side transfer ports of adjacent cylinders. Examples of engines with a skewed scavenge axis are disclosed in U.S. Pat. No. 4,092,958 to Hale, and in German Pat. Nos. 665126 to Humboldt-Deutzmotoren Akt. and 663500 to Auto-Union AG. These and similar configurations of the side transfer ports and passages does contribute to a degree of reduction in the overall length of a cylinder block, but there is still the need to provide a substantial spacing between the adjacent cylinders, and to provide space at the ends of the cylinder block to accommodate the transfer ports and passages.

The skewing of the scavenging axis also necessitates the exhaust port of each adjacent cylinder being located so that the axis of the exhaust port is inclined to the common longitudinal plane of the cylinders. This inclined attitude of the axis of the exhaust port introduces complications if it is desired to provide a valve to regulate the timing and/or extent of opening of the exhaust port, as a means of improving the power output and/or controlling exhaust emissions and fuel consumption. In multi-cylinder engines, with the axis of each exhaust port inclined to the common longitudinal plane of the cylinder block, the valve associated with each port is mounted on a respective pivot axis transverse to the axis of the exhaust port. It is consequently necessary to provide individual coupling of each valve to a suitable actuator device, or to provide a form of flexible coupling between the valves of each exhaust port of the engine. Both of these forms of construction are relatively complex and are therefore expensive to manufacture and maintain.

There is disclosed in U.S. patent application Ser. No. 866,426 and corresponding Australian Patent Application Ser. No. 57898/86 an exhaust port valve in a skew scavenged axis engine wherein the pivot axis of the valve is inclined to the exhaust port axis. This construction enables the valves of a number of exhaust ports in a multi-cylinder engine to be mounted on a single actuating shaft. However, in this construction there is a substantial area of the valve located within the exhaust port and hence exposed to the high temperature exhaust gases. This results in some operational problems due to clearance that must be provided for the moving valve, and carbon build-up on the exposed surface of the valve and the exhaust port areas over which the valve moves when in operation. The manufacture of these valves is also complex and hence expensive.

It is the object of the present invention to provide an improved arrangement of the exhaust and transfer ports in a multi-cylinder two stroke cycle engine to provide the required gas flow within the cylinders of the engine, while also permitting the overall length of the cylinder block to be reduced, and the installation of simple exhaust port controls.

With this object in view there is provided according to the present invention a multi-cylinder engine block for an internal combustion engine operating on the two-stroke cycle and having two or more adjacent cylinder bores in said block with the axes of the bores parallel and in a common longitudinal plane, each cylinder bore having a respective exhaust port, an exhaust passage extending from each exhaust port to an external surface of the block in a direction generally at right angles to said common longitudinal plane, two first transfer ports in that portion of the block between the exhaust passages of two adjacent cylinder bores, each first transfer port communicating with a respective one of said two adjacent bores, each first transfer port communicating with a respective first transfer passage formed in said portion of the block between the exhaust passages, the first transfer port and associated first transfer passage of each of said two adjacent cylinder bores being located on opposite sides of a transverse plane substantially at right angles to said common longitudinal plane and midway between the axes of said two adjacent cylinder bores, said first transfer ports and first transfer passages being configured and located so the axes of the two adjacent cylinder bores are spaced apart not more than about 1.22 times the diameter of the cylinder bores.

Preferably each of the two adjacent cylinder bores is provided with at least one additional transfer port in that portion of the cylinder bore on the opposite side of the common longitudinal plane to that where the exhaust port is provided. The additional transfer ports on said opposite side of the common longitudinal plane are also preferably arranged so that they do not extend beyond the above referred to transverse plane between said two adjacent cylinder bores.

Conveniently, the arrangement of the additional transfer ports may include three ports, a central port diametrically opposite the exhaust port and two further side ports, one on either side of the central transfer port. These side ports, and the transfer passages communicating therewith, preferably do not extend beyond said transverse plane. The central transfer port may be in the form of a single port with an upright divider, the two ports so formed communicating with a common transfer passage. Alternatively there may be two central transfer ports with respective transfer passages.

Conveniently the transfer ports on the same side of the common longitudinal plane as the exhaust port do not extend in the circumferential direction around the cylinder bore beyond the common longitudinal plane. Further it is desirable that the transfer passages associated with those transfer ports do not extend from the port in the direction of said common longitudinal plane a distance greater than the thickness of the wall of the cylinder at that location. That portion of the transfer passage which is immediately adjacent the transfer port on the exhaust port side of the engine, preferably extends generally in the tangential direction with respect to the bore of the associated cylinder at the common longitudinal plane. This portion of the transfer passage directs the charge entering the cylinder in a direction toward the opposite side of the cylinder in a direction generally at right angles to the common longitudinal plane.

The transfer passages associated with the central ports, and with the two side transfer ports on the side of the bore opposite to the exhaust port, are shaped so that the charge entering the cylinder through these ports is directed upwardly in the cylinder. This upward movement is further promoted by the upward movement of the piston in the engine cylinder to thereby establish the required upward flow of the incoming gases as the initial part of the loop-scavenge movement of the incoming gases. In contrast, the charge entering the cylinder through the transfer ports on either side of the exhaust port is generally directed across the cylinder bore towards the central transfer port or ports so that charge is directed away from the exhaust port and the general flow of exhaust gases towards that exhaust port.

The above arrangement of the transfer ports and associated passages, so that the transfer ports, on the exhaust port side of the engine, do not extend through the transverse plane between two adjacent cylinders, enables the center distance between the respective cylinder bores to be substantially reduced so that the distance between the bores, measured in said longitudinal plane is not substantially more than the required wall thickness of the two cylinders. This construction substantially reduces the overall length of a multi-cylinder engine cylinder block, as compared with previously known cylinder blocks wherein the cylinder bores are spaced a substantial distance apart so to accommodate transfer passages in the area between any two cylinders.

A space reduction is also possible at each end of the multi-cylinder block, as the transfer ports at the outer side of the end cylinder bores do not require additional space beyond that required for the normal cylinder wall thickness, and water jacket or other cooling provision as required.

The above described positioning of the transfer ports and associated passages between the exhaust ports of adjacent cylinders, enables the center distance between adjacent cylinder bores to be reduced to the order of a range of 1.08 to 1.22 times the diameter of the cylinder bore, and preferably about 1.19 times the cylinder bore, for an engine bore in the range of about 75 to 110 mm diameter. The relation of cylinder bore size to cylinder spacing is influenced by bore size as the required wall thickness about the bores increases with bore diameter to maintain the tensile loading in the wall within allowable limits.

In addition, the locating of the exhaust ports and associated passages to extend in a direction generally normal to the common longitudinal plane of the axes of the cylinder bores, simplifies the construction of exhaust valves and actuating mechanisms for such exhaust valves when fitted to the exhaust ports.

The invention will be more readily understood from the following description of one construction of the cylinder block with reference to the accompanying drawings.

In the drawings:

FIG. 4 is a sectional view on the line 4—4 in FIG. 3;

FIG. 5 is a sectional view on the line 5—5 in FIG. 3;

FIG. 6 is a sectional view on the line 6—6 in FIG. 3;

FIG. 8 is a sectional view on line 8—8 in FIG. 1.

Figure 1:
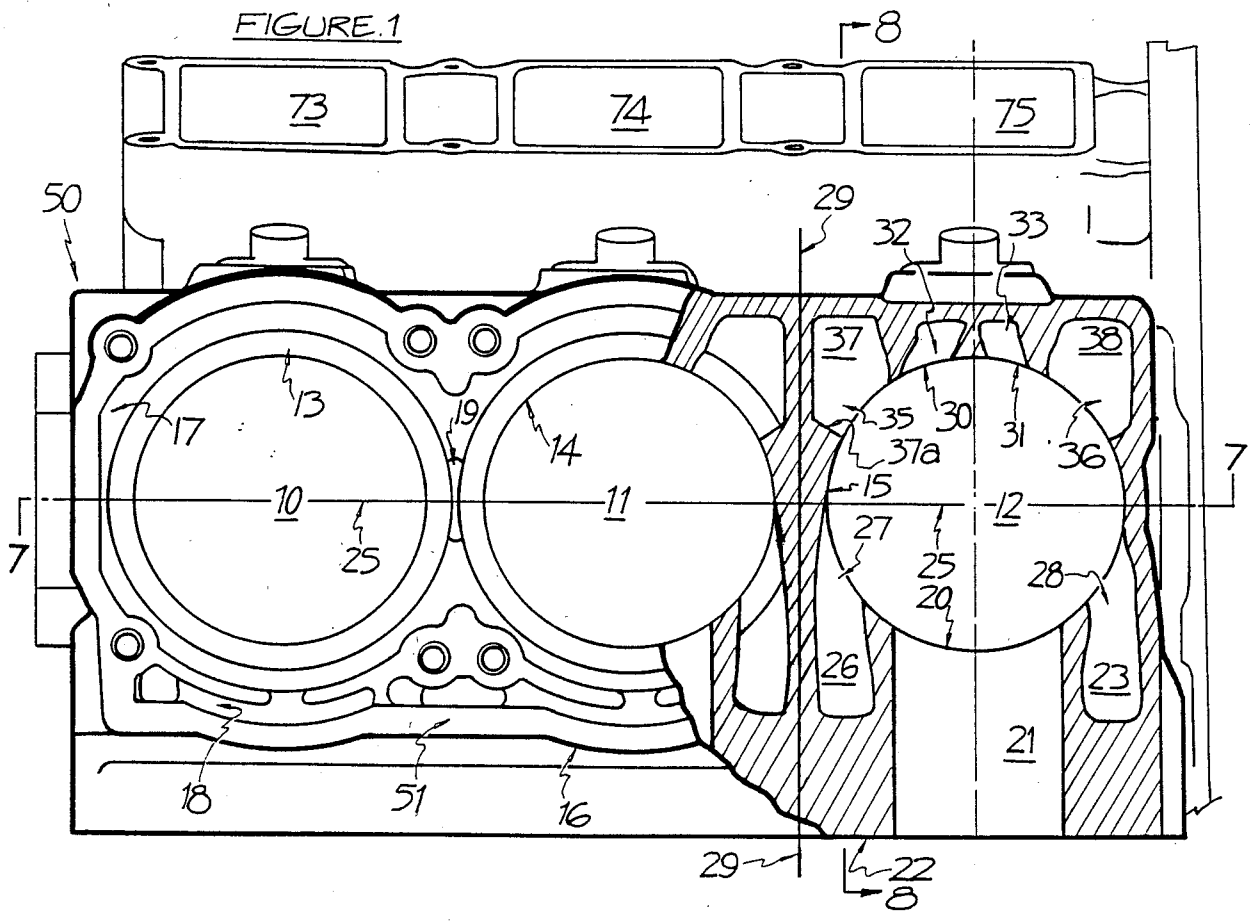
FIG. 1 is a plan view of the cylinder block of a three cylinder two-stroke engine with portion thereof in section along line 1—1 in FIG. 3 being a cylinder diametrical plane passing through the exhaust and transfer ports of that cylinder.
Figure 2:
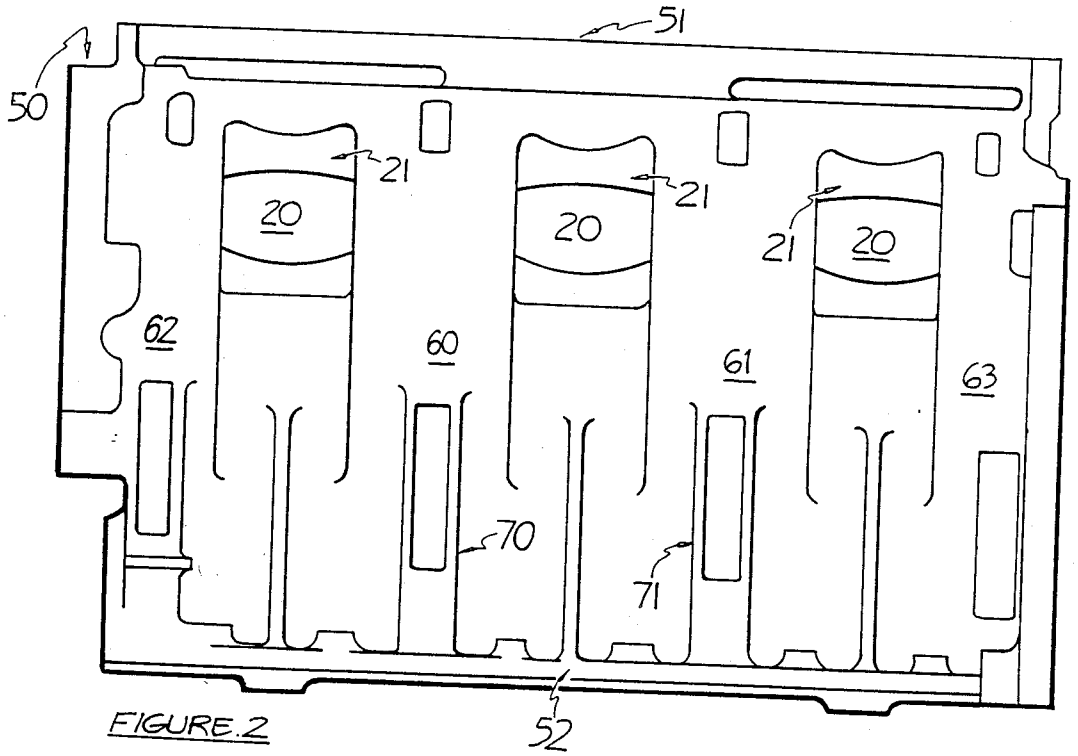
FIG. 2 is a view from the exhaust port side of the cylinder block shown in FIG. 1.
Figure 3:
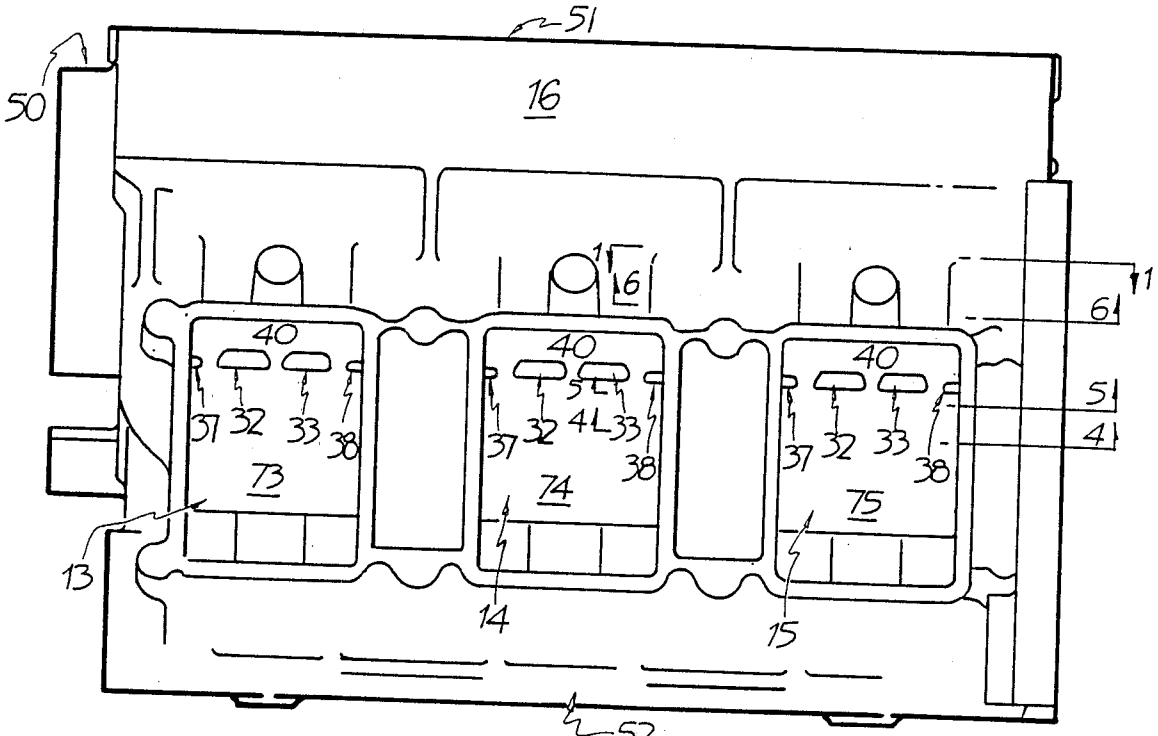
FIG. 3 is a view of the induction side of the cylinder block shown in FIG. 1.

Referring now to FIGS. 1, 2 and 3 of the drawings, the cylinder block 50 has three cylinders 10, 11 and 12 provided therein with the axes of the cylinders parallel and located in a common longitudinal plane 25. The top face 51 of the block is at right angles to the common longitudinal plane 25 and is planar so that a cylinder head may be fitted thereto in the conventional manner.

Along one side of the block, as seen in FIG. 2, there are provided three exhaust passages 21 which project inwardly from the external side face 22 of the block to the exhaust ports 20 in the engine cylinders as will be described further hereinafter. On either side of the exhaust port of the center cylinder 11 there is provided respective outwardly convex surfaces at 60 and 61 which effectively increase the width of the cylinder block at those locations to provide for two transfer passages through the block as hereinafter described. Similar, but of lesser width in the longitudinal direction, outwardly convex portions 62 and 63 are provided at either end of the block, outwardly of the exhaust ports of the end cylinders 10 and 12, which provide for a single internal transfer passage. Two series of stiffening webs 70 and 71 are provided on the sidewall of the block 50 as seen in FIG. 2 extending upwardly from the flange 52 along the lower marginal edge of the block. The flange co-operates with a suitably constructed crankcase lower portion, (not shown) which, together with a cavity area within the lower portion of the block, provides the conventional two stroke cycle engine crankcase.

FIG. 3 of the drawings shows the block from the opposite side to that shown in FIG. 2, wherein there are provided three air intake or induction passages 73, 74 and 75, which communicate respectively with the crankcase area associated with each of the cylinders 10, 11 and 12. This particular engine in use is fitted with direct fuel injection through the head, so no fuel enters the crankcase in this region. However, the invention in its broad sense is not limited to direct injected engines. As can be seen in the sectional drawing FIG. 4, the air intake passages project a substantial distance laterally from the main portion of the cylinder block. The lower end of transfer passages 32 and 33 open through the upper wall 40 of the air intake passage of each cylinder in the central area thereof. The further transfer passages 37 and 38 similarly communicate with the air induction passage towards either side thereof. The apparent difference in dimensions of the passages 32 and 33 relative to passages 37 and 38, is caused by the transfer passages 32 and 33 breaking through a portion of the upper wall 40 that is less inclined to the vertical than the portion where the passages 37 and 38 break through. Also the transfer passages 37 and 38 break through the side walls of the intake passage which are not shown in the drawings. This gives the impression that the latter two passages are of a narrower height, however, as can be seen in the various cross sectional views through the cylinder block as in FIGS. 4 and 5 all these four transfer passages are of comparable size.

Referring now to FIG. 1 of the drawings, each of the three cylinders 10, 11 and 12, are defined by cylinder walls 13, 14 and 15. The cylinder walls are connected at various locations to the unitary outer casing 16 of the cylinder block 50 and define therebetween respective cooling water passages some of which are shown at 17, 18 and 19. More specifically the cylinder walls 13, 14 and 15 are integral with the outer casing 16 at the lower end of the cylinder walls as can be seen in FIG. 4, to form a complete water barrier therebetween. The cylinder block is substantially open at the upper end to provide passageways for the flow of water into a detachable cylinder head when installed.

As can be seen from the sectioned portion of the cylinder 12 in FIG. 1, the exhaust port 20 communicates the bore of the cylinder 12, with the exhaust passage 21 which extends to the external face 22 of the outer casing 16 of the cylinder block. The exhaust passage 21 extends generally in a direction normal to the longitudinal plane 25, which is common to the axes of the three cylinders 10, 11 and 12. On either side of the exhaust passage 21 are transfer passages 23 and 26 which communicate respectively with the transfer ports 28 and 27. It will be noted that the ports 27 and 28 do not extend in the circumferential direction of the cylinder 12 beyond the common longitudinal plane 25, and the port 27 and associated transfer passage 26 does not extend beyond the transverse plane 29, at right angles to the common longitudinal plane 25 and located midway between the axis of the cylinder 12 and the adjacent cylinder 11.

On the opposite side of the common longitudinal plane 25 there is provided in the cylinder 12 two central transfer ports 30, 31 each communicating with a respective transfer passages 32, 33. On either side of the central transfer ports 30, 31 there are further transfer ports 35 and 36 communicating with respective transfer passages 37 and 38. It will be noted that the transfer port 35 and associated passage 37 again do not extend beyond the transverse plane 29 at right angles to the longitudinal plane 25.

As can be seen in FIG. 1, the transfer passages 23 and 38 do not extend, in the longitudinal direction of the cylinder block, beyond the thickness of the wall of the cylinder 12. Accordingly the cylinder block is not required to provide significant additional length in the longitudinal direction to accommodate the transfer ports and passages of the ends of the cylinder block.

Each of the transfer passages 23 and 26, extend downwardly through the cylinder block as seen in FIG. 5 to open through the lower part of the wall 15 of the cylinder to communicate with the crankcase 42 of the engine. Similarly the transfer passages 32, 33, 37 and 38 from the other transfer ports 30, 31, 35 and 36 also extend down and open through the upper face 40 of the intake passage to communicate with the crankcase 42.

In accordance with conventional two stroke cycle engine construction each cylinder has an independent crankcase compartment and the air charge is drawn into each compartment, through the respective intake passages 73, 74 and 75, controlled by reed or other valves (not shown), by the movement of the piston, (not shown) reciprocating in the cylinder. The air is subsequently compressed in the crankcase as the piston moves down the cylinder to thereby displace the air charge from the crankcase through the various transfer passages and through the transfer ports into the engine cylinder.

Figure 7:
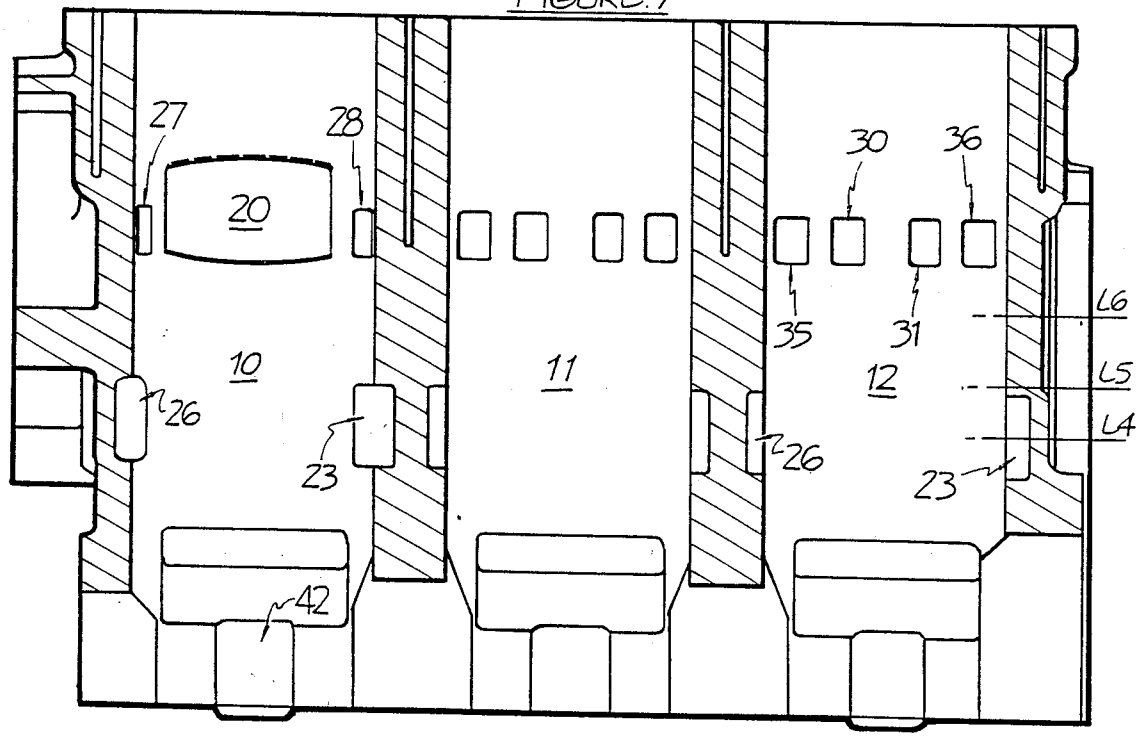
FIG. 7 is a sectional view of the cylinder block along line 7—7 in FIG. 1, being the longitudinal plane 25 of the cylinder block.

FIG. 4 is a sectional view along the line 4—4 in FIG. 2, the section being taken through the rear, and portion of the next to rear, cylinders 11 and 12 of the engine. It will be noted from FIG. 7, wherein the level of the section line 4—4 is noted at L4, that the section 4—4 extends through the cylinder block at the level where the lower ends of transfer passages 23 and 26 communicate with the cylinders. It will further be noted that the level L4 is below that at which the transfer passages 32, 33, 37 and 38 communicate with the main induction passage 75 of cylinder 12. As can be seen in FIGS. 4 and 7 the transfer passages 23 and 26 open through the cylinder wall 15 into the cylinder 12 at a location spaced upwardly from the lower end of the cylinder. Accordingly, as is known in the art of two stroke cycle engines, suitable openings are provided in the skirt of the piston (not shown) reciprocating in the cylinder 12 to permit a charge from the engine crankcase 42 to enter the transfer passages 23 and 26, as the piston moves down in the cylinder bore.

FIG. 5 is a section similar to that shown in FIG. 4, but at a higher level in the cylinder block, being at level L5, shown in FIG. 7. At this level the section is taken a short distance below the upper wall 40 of the intake passage 75 from which the transfer passages 32, 33, 37 and 38 communicate with the engine crankcase 42. It will be further noted that at this level the transfer passages 23 and 26 have extended outwardly with respect to the common longitudinal plane 25 of the cylinders and are now located within the outwardly convex portions 61 and 63 of the cylinder block previously referred to in the description relating to FIG. 1 of the drawings. The provision of these outwardly projecting convex portions in the side of the block enable the transfer passages 23 and 26 to be made of a sufficient cross-section for the free flow of the charge from the crankcase to the cylinders, without requiring the center distance between the cylinders to be enlarged to accommodate such transfer passages. It will further be noted from FIG. 5 that the transfer passages 37 and 38 are of a substantial cross-section, and have been extended somewhat in the longitudinal direction of the engine. In this regard it must be understood that only part of the lower end of the transfer passages 37 and 38 are seen in FIG. 4, as previously explained, and the true effective cross-sectional area of the transfer passage is considerably greater than the area as seen in FIG. 4.

The cross-section as shown in FIG. 6 is at a level slightly below the level of the exhaust passage 21 and is indicated as level L6 in FIG. 7. This view shows the true cross-sectional area of each of the transfer passages 23, 26, 32, 33 37 and 38 as they pass upwardly through the engine block to communicate with the respective ports in the wall 13 of the cylinder bore 10.

The approximate areas of the respective groups of transfer passages at level L6 are:

| Transfer Passages | Combined Area ($mm^2$) |
|---|---|
| 23–26 | 820 |
| 32–33 | 580 |
| 37–38 | 860 |

It will be appreciated from a consideration of the areas of the respective groups of transfer passages that approximately 26% of the incoming charge will enter the cylinder through the two central transfer ports located directly opposite the exhaust port and approximately a further 38% of the charge will enter through the two side transfer ports located one on either side of the central transfer ports. The remaining approximate 36% of the charge will enter the cylinder through the two transfer ports located one on either side of the exhaust port with this part of the charge being directed generally towards the center transfer ports on the opposite side of the cylinder along a path which will intersect the common longitudinal plane of the engine at substantially a right angle. The directing of this not insignificant portion of the fresh charge from the exhaust port side of the engine towards the opposite side where the central and side transfer ports are provided assists in controlling the movement of the charge entering through the central and side transfer ports against flowing across the cylinder to escape through the exhaust port. Also the flow of charge from the transfer ports on either side of the exhaust port assists in promoting the upward movement of the incoming fresh charge along the wall of the cylinder opposite to the exhaust port to establish the required loop-scavenge motion of the incoming fresh charge.

It will also be seen from FIG. 8 of the drawings that the portion of the transfer passage 26 immediately downstream from the transfer port 27 is generally at right angles to the common longitudinal plane 25 passing through the axes of the cylinders of the engine so that the incoming fresh charge entering the cylinder through the transfer port 27 will have a generally horizontal trajectory so that it will pass directly across the cylinder towards the transfer ports on the opposite side of the cylinder bore and will not become entrained in or interfere with the flow of exhaust gases entering the exhaust port 20 adjacent to the transfer port 27. It will further be noted from FIG. 8 that the portion of the transfer passage 37 immediately upstream of the port 35 has a generally upwardly inclined direction to impart an upward trajectory to the fresh charge entering the cylinder through the transfer port 35. It will further be noted from FIG. 1 that the wall portion 37*a* of the transfer passage 37 will promote a flow of the incoming charge from the port 35 in a direction generally across the cylinder towards the transfer port 36 so that incoming charge will not be directed directly towards the exhaust port 20. It is also to be noted, although it is not illustrated in the accompanying drawings that the transfer passages 32 and 33 are similarly inclined upwardly at the ports 30 and 31 so that the fresh charge entering through these ports will also be directed upwardly in the cylinder.

The above discussed direction of flow of the incoming fresh charge from the respective groups of transfer ports establish that the incoming fresh charge is generally all directed to that part of the cylinder on the side of the common longitudinal plane 25 opposite from the side where the exhaust port 20 is located. This establishes within the cylinder, during the period that the transfer ports and exhaust ports are simultaneously open, a loop-scavenge flow of the incoming gases to effect discharge of the exhaust gases through the exhaust port with a minimum loss of fresh charge with that exhaust gas. This desired flow of the gases in the cylinder is obtained without the need to arrange the exhaust port with its axis inclined to the common longitudinal plane of the engine so that the scavenge axis of the engine is in a skewed relationship to the common longitudinal plane. Further, this desired scavenging action is obtained whilst also achieving a substantial reduction in the overall length of the cylinder block of the multi-cylinder engine as compared with the overall length required for a loop-scavenged engine with a skewed scavenge axis.

By way of comparison, it is to be noted that the engine in accordance with the present invention was developed to replace a prior construction in which the skewed scavenge axis was incorporated. The prior engine was of a three cylinder in-line construction having a nominal cylinder bore of 84 mm and an overall cylinder block length of 337 mm. This prior engine had a total transfer passage cross-sectional area of 1840 $mm^2$ measured at a location corresponding to that in FIG. 6.

The comparable engine constructed in accordance with the present invention and still having a nominal engine bore of 84 mm, has an overall engine block length of 305 mm, representing a reduction of about 10% in the overall length of the engine. In the prior engine the center distance between cylinders was 1.25 times the cylinder bore, whereas in the engine according to the present invention the ratio is 1.19. This reduction in overall length was achieved with a substantial increase in total transfer passage cross-section to 2260 $mm^2$.

Measurements have also been made of multi-cylinder in-line engine assemblies wherein a three cylinder engine with a 79 mm bore had an overall length of 353 mm, and one with an 82 mm bore had an overall length of 337 mm. These same engines had a cylinder center distance to diameter ratio of 1.4 and 1.28 respectively.

The engine block described herein is constructed for a spark ignited engine operating on the crankcase compression principle and accordingly the transfer passages communicate the transfer ports with the engine crankcase. It is to be understood that the arrangement of transfer ports on each side of the exhaust port as herein disclosed may also be incorporated in a super-charged engine, where the transfer ports would communicate by suitably located transfer passages to a source of pressurized air or air and fuel mixture.

In either of the above referred to forms of the engine the fuel may be provided by carburetor or injection means, including injection means that delivers the fuel directly into the engine cylinders.

The engine block herein disclosed may be incorporated in engines for any use, including motors for vehicles such as automobiles and outboard marine engines.

The claims defining the invention are as follows, we claim:

1. A multi-cylinder engine block for an internal combustion engine operating on the two-stroke cycle and having two or more adjacent cylinder bores on said block with the axes of the bores parallel and in a common longitudinal plane, each cylinder bore having a respective exhaust port, an exhaust passage extending from each exhaust port to an external surface of the block with a portion of the exhaust passage adjacent the exhaust port extending in a direction generally at right angles to said common longitudinal plane, two first transfer ports in a portion of the block between the exhaust passages of each two adjacent cylinder bores and on the same side of the common longitudinal plane as the exhaust ports, each first transfer port communicating with a respective one of said two adjacent bores, each first transfer port communicating with a respective first transfer passage formed in said portion of the block between the exhaust passages, the first transfer port and associated first transfer passage of each of said two adjacent bores being located on opposite sides of a transverse plane substantially at right angles to said common longitudinal plane and midway between the axes of said two adjacent cylinder bores, said first transfer ports and first transfer passages being configured and located so the axes of the two adjacent cylinder bores are spaced apart not more than about 1.22 times the diameter of the cylinder bores.

2. A multi-cylinder engine block as claimed in claim 1, wherein a further transfer port is provided to communicate with the respective cylinder bores, each further transfer port being located on the opposite side of the exhaust port of the respective cylinder bore to the first transfer port, said first and further transfer ports being symmetrical with respect to a transverse plane at right angles to said common longitudinal plane and passing through the axis of the bore.

3. A multi-cylinder engine block as claimed in claim 2, wherein said first and further transfer ports and substantially entirely on the same side of said common longitudinal plane as the exhaust ports.

4. A multi-cylinder engine block as claimed in claims 1 or 2, wherein each first transfer passage has a portion adjoining the communicating first transfer port that extends in a direction substantially tangential to the cylinder bore at the intersection of the cylinder bore with said common longitudinal plane.

5. A multi-cylinder engine block as claimed in claims 2 or 3, wherein the first and further transfer passages each have a portion adjoining their respective ports that extends in a direction substantially tangential to the cylinder bore at the respective intersections of the cylinder bore with said common longitudinal plane.

6. A multi-cylinder engine block as claimed in claim 1, 2, or 3, wherein additional transfer ports are provided in each cylinder bore in that part of each bore on a side of said common longitudinal plane opposite to the exhaust port.

7. A multi-cylinder engine block as claimed in claim 1 or 2 having additional transfer ports in each cylinder bore located on a side of said common longitudinal plane opposite to the exhaust port, said additional transfer ports including two side transfer ports in each cylinder bore spaced on opposite sides of a central transverse plane at right angles to the common longitudinal plane and passing through the axis of the cylinder bore, said two side transfer ports communicating with respective side transfer passages formed in the block with said cylinder bore and each respective side transfer port and communicating transfer passage being configured and located on only one side of said transverse plane midway between the axes of adjacent cylinder bores.

8. A multi-cylinder engine block as claimed in claim 7, wherein the portion of each transfer passage adjoins its respective side transfer port is shaped to direct charge fluid entering the cylinder bore through said side transfer port upwardly and generally diametrically across the cylinder bore.

9. A multi-cylinder engine block as claimed in claim 7, wherein said additional transfer ports include at least one transfer port in the block generally opposite to the exhaust port and communicating with a respective transfer passage formed on the block.

10. A multi-cylinder engine block for an engine operating on the two-stroke cycle and having two or more adjacent cylinder bores in said block with the axes of the bores parallel and in a common longitudinal plane, each cylinder bore having a respective exhaust port, an exhaust passage extending from each exhaust port to an external surface of the block with a portion of the exhaust passage adjacent the exhaust port extending in a direction generally at right angles to said common longitudinal plane, two transfer ports in a portion of the block located on either side of each exhaust port in the direction of said common longitudinal plane and each transfer port communicating with the same cylinder bore as the exhaust port therebetween, each transfer port communicating with a respective transfer passage, the adjacent transfer ports and associated transfer passages of two adjacent cylinder bores being located on the same side of the common longitudinal plane as the exhaust ports and on opposite sides of a transverse plane which is substantially at right angles to said common longitudinal plane and is midway between the axes of said two adjacent cylinder bores, said transfer ports and transfer passages being configured and located so the axes of the two adjacent cylinder ports are spaced apart not more than about 1.22 times the diameter of the cylinder bores.

* * * * *